US006039537A

United States Patent [19]

Scheurlen

[11] Patent Number: 6,039,537

[45] Date of Patent: Mar. 21, 2000

[54] TURBINE BLADE WHICH CAN BE SUBJECTED TO A HOT GAS FLOW

[75] Inventor: Michael Scheurlen, Mülheim an der Ruhr, Germany

[73] Assignee: Siemens Aktiengesellschaft, Munich, Germany

[21] Appl. No.: 09/262,464

[22] Filed: Mar. 4, 1999

Related U.S. Application Data

[63] Continuation of application No. PCT/DE97/01826, Aug. 22, 1997.

[30] Foreign Application Priority Data

Sep. 4, 1996 [DE] Germany ..... 196 35 928

[51] Int. Cl.[7] ..... F01D 5/18

[52] U.S. Cl. ..... 416/97 R; 416/96 R; 416/96 A; 416/241 R; 416/241 B; 415/115

[58] Field of Search ..... 416/97 R, 96 R, 416/97 A, 241 R, 241 B; 415/115

[56] References Cited

U.S. PATENT DOCUMENTS 5,030,060 7/1991 Liang ..... 415/115

FOREIGN PATENT DOCUMENTS 7-229402 8/1995 Japan .

*Primary Examiner*—Edward K. Look
*Assistant Examiner*—Richard Woo
*Attorney, Agent, or Firm*—Herbert L. Lerner; Laurence A. Greenberg

[57] ABSTRACT

A turbine blade which can be subjected to a hot gas flow includes a substrate, at least one interior space and a plurality of bores leading from the interior space out of the substrate. The substrate is at least partly covered by a heat-insulating-layer system at a suction side and/or a pressure side. At least one of the bores is closed by the heat-insulating-layer system and at least one further bore is open for developing film cooling.

12 Claims, 2 Drawing Sheets

TURBINE BLADE WHICH CAN BE SUBJECTED TO A HOT GAS FLOW

CROSS-REFERENCE TO RELATED APPLICATION

This application is a continuation of copending International Application No. PCT/DE97/01826, filed Aug. 22, 1997, which designated the United States.

BACKGROUND OF THE INVENTION

Field of the Invention

The invention relates to a turbine blade which can be subjected to a hot gas flow, including a substrate having at least one interior space and a plurality of bores leading from the interior space out of the substrate, and a heat-insulating-layer system at least partly covering the substrate at a suction side and/or a pressure side.

A product having a heat-insulating-layer system is disclosed in U.S. Pat. No. 4,320,310 or U.S. Pat. No. 4,320,311.

International Publication No. WO 96/12049 A1 discloses the structure of such a heat-insulating-layer system. In that device, the heat-insulating-layer system is formed of a ceramic heat-insulating layer and an adhesive layer. The substrate is formed of a superalloy, the adhesive layer is an alloy of the type MCrAlY containing a portion of the element rhenium as an essential feature, and the heat-insulating layer is formed of stabilized or partly stabilized zirconium oxide. Such zirconium oxide is a mixture of zirconium oxide in the actual sense and at least one further component, in particular yttrium oxide, calcium oxide, magnesium oxide, cerium oxide or ytterbium oxide. The presence of the further component serves to thermally stabilize the zirconium oxide and prevent it from undergoing a phase transformation at the temperatures to be expected during operation. Zirconium oxide is often used as a basis for a ceramic heat-insulating layer, since it has certain mechanical properties which are similar to the mechanical properties of the metals used for the substrate and a possible adhesive layer. Dangerous mechanical stresses between the heat-insulating layer and the metals are thereby avoided at the temperatures to be expected during operation.

European Patent EP 0 486 489 B1 as well as U.S. Pat. Nos. 5,154,885, 5,268,238 and 5,273,712 disclose alloys of the type MCrAlY, which are resistant to corrosion and oxidation at high temperatures and are readily suitable as adhesive layers for ceramic heat-insulating layers.

German Published, Non-Prosecuted Patent Application DE 38 21 005 A1 describes a metal/ceramic composite blade for turbo-machines, in particular gas turbine power units. The composite blade has at least one bulk ceramic part on leading and/or trailing edges which is anchored to a refractory metallic base element of the blade in such a way as to compensate for expansion and in such way that it can be replaced. The blade has a cooling channel inside it, through which coolant can be fed to the pressure and suction side of the blade. There are also cooling-air bores which branch off from the cooling channel, open onto the bulk ceramic part at the leading edge and are closed off by that part. If the ceramic part fractures, the cooling air bores will be exposed in corresponding places, so that it is possible for a secure hot-gas shield to be formed at those points where ceramic elements have broken. Furthermore, German Published, Non-Prosecuted Patent Application DE 38 21 005 A1 gives the option of applying metal oxide thermal barrier layers to the pressure and/or suction outer surfaces of the blade, but without going into detail about the geometrical configuration of the thermal barrier layers.

U.K. Patent Application GB 2 259 118 A, corresponding to U.S. Pat. No. 5,269,653, relates to a gas turbine blade which has an inner cooling channel and is completely provided with a thermal barrier coating. The cooling channel is connected to a cooling chamber assigned to the upstream edge of the turbine blade. Following erosion of the thermal barrier layer and of the base material of the turbine blade in the upstream edge region, the cooling chamber is opened so as to produce laminar cooling of the upstream edge in order to reduce further wearing-down of the base material.

The invention relates in particular to a turbine blade which is constructed as a gas-turbine blade and which is subjected, within the limits of its normal operation, to a hot gas flow that is developed by a flue gas formed by burning a fuel with excess air and has a temperature which can be 1200° C. to 1400° C. on average. Even higher temperatures are taken into consideration and, in order to cope with the problems associated with those temperatures, the development of corresponding gas-turbine blades is steadily advanced. In that case, gas-turbine blades having heat-insulating-layer systems of the type described are considered to be especially important.

A particular problem of a heat-insulating-layer system having a ceramic heat-insulating layer is the brittleness of the ceramic. The possibility of cracks occurring in the heat-insulating-layer system and of the ceramic chipping in the course of normal operation can never be completely ruled out. In that case, the metallic base of the ceramic will possibly be exposed and subjected to the hot gas flow. Any metallic adhesive layer which is present will certainly ensure a certain degree of protection against oxidation and corrosion, especially when the adhesive layer is formed of an MCrAlY alloy or an aluminide. However, due to the loss of the thermal insulation, the adhesive layer will be subjected to extreme thermal loading, so that immediate failure of the adhesive layer has to be expected. That leads to a situation in which the potential of a heat-insulating-layer system with regard to its protective effect will only be utilized with caution, that is it will be less than fully utilized as a rule, within the limits of conventional practice.

SUMMARY OF THE INVENTION

It is accordingly an object of the invention to provide a turbine blade which can be subjected to a hot gas flow, which overcomes the hereinafore-mentioned disadvantages of the heretofore-known devices of this general type and which permits a protective effect of a heat-insulating-layer system to be largely utilized as far as possible, so that a risk of immediate failure of the protective effect after a fracture in the heat-insulating-layer system is removed and an increase in thermal loading of the turbine blade as compared with turbine blades of the prior art is possible.

With the foregoing and other objects in view there is provided, in accordance with the invention, a turbine blade to be subjected to a hot gas flow, comprising a suction side; a pressure side; a substrate having at least one interior space and a plurality of bores leading from the interior space out of the substrate; and a heat-insulating-layer system at least partly covering at least one of the suction and pressure sides, the heat-insulating-layer system closing at least one bore and leaving at least one further bore open to emit cooling fluid for developing film cooling of the heat-insulating-layer system.

According to the invention, in the event of a failure of the heat-insulating-layer system in the affected region of the turbine blade, provision is made for additional cooling by virtue of the fact that the heat-insulating-layer system which breaks off opens the closed bore and enables a coolant, which is operationally admitted to the interior space anyway, to flow through the opened bore and thus intensify the cooling of the affected region. The heat-insulating-layer system is constructed in such a way that the use of the closed bore for cooling the turbine blade is not necessary in the case of an undamaged heat-insulating-layer system. The demand for coolant can therefore be adapted to the protective properties of the heat-insulating-layer system and be kept at a correspondingly low level. In addition, the provision of corresponding bores to be closed by the heat-insulating-layer system enables the turbine blade to be reliably cooled by repeated discharge of coolant from the interior space, and thus protected against undesirable failure even in the event of a loss of the heat-insulating-layer system.

In accordance with another feature of the invention, the at least one further bore passes through and is not closed by the heat-insulating-layer system. Consequently, the turbine blade can also be cooled in a desired manner when the heat-insulating-layer system is intact, so that a further increase in the thermal loading is possible.

In accordance with a further feature of the invention, there is provided a plurality of bores which are not closed by the heat-insulating-layer system and are disposed in such a way that the substrate is uniformly cooled when the hot gas flow flows around it and when a coolant is fed to the interior space, wherein the coolant is drawn off into the gas flow through the bores which are not closed.

In accordance with an added feature of the invention, all of the bores are disposed in the substrate in such a way that the substrate is uniformly cooled when the hot gas flow flows around it, if the heat-insulting-layer system opens previously closed bores when a cooling fluid drawn off through the bores into the gas flow is fed to the interior space. This ensures suitable cooling of the turbine blade in the event of a complete or partial failure of the heat-insulating-layer system. This is of particular importance in connection with the structure described previously having a preferred configuration of the bores not to be closed by the heat-insulating-layer system. Thus the turbine blade provides reliable cooling under all circumstances if a corresponding coolant is admitted to it through its interior space during loading with a hot gas flow. However, when the heat-insulating-layer system is intact, the cooling of the turbine blade effected through the use of the coolant is clearly reduced, since all bores are closed, through which a flow does not have to take place due to the insulating properties of the heat-insulating-layer system. In addition, such a structure also permits monitoring of the turbine blade with regard to the integrity of the heat-insulating-layer system by the inflow of the coolant being measured and compared with a value which must appear when the heat-insulating-layer system is intact, with all corresponding bores being closed.

If the heat-insulating-layer system opens a bore in the event of a local failure, the inflow of coolant to the turbine blade must increase accordingly, which would be easily noticeable during the course of monitoring the inflow.

In accordance with an additional feature of the invention, the substrate is formed of a superalloy, in particular a superalloy normally used to produce gas-turbine blades.

In accordance with yet another feature of the invention, the heat-insulating-layer system of the turbine blade includes a metallic adhesive layer lying on the substrate and a ceramic heat-insulating layer lying on the adhesive layer.

In accordance with yet a further feature of the invention, the adhesive layer is formed of an alloy resistant to corrosion and oxidation at high temperatures, in particular an alloy of the MCrAlY type. M designates one or more of the elements Fe, Ni or Co, Y designates yttrium and/or one or more of the elements of rare earths. Such an adhesive layer has the advantage of continuing to ensure protection against corrosion and oxidation in the event of a loss of the ceramic heat-insulating layer. It may be noted that such protection is also of importance when the heat-insulating-layer system is intact, since it must always be expected that flue gas could pass out of the gas flow through the ceramic heat-insulating layer and attack metallic regions of the turbine blade under the ceramic heat-insulating layer. Such a phenomenon is reliably prevented by the provision of an appropriately effective adhesive layer. It may be noted that, in conformity with the information obtainable from the prior art, an intermediate layer of aluminum oxide or the like may form between the metallic adhesive layer and the actual ceramic heat-insulating layer. The intermediate layer results from the oxidation of aluminum, which diffuses out of the adhesive layer, with oxygen which passes out of the flue-gas flow through the ceramic heat-insulating layer to the adhesive layer. Such an intermediate layer, which in accordance with relevant experience becomes enlarged during the operation of the turbine blade, should be expected to appear. It is also not out of the question to modify the adhesive layer by special aftertreatment, for example by the diffusion of aluminum or the application of a special surface coating, before the ceramic heat-insulating layer is applied.

In accordance with yet an added feature of the invention, the heat-insulating layer is formed of a stabilized or partly stabilized zirconium oxide. The meaning of the terms "stabilized/partly stabilized zirconium oxide" as well as the properties of a heat-insulating layer which is produced therefrom have already been explained, to which reference is herewith made.

In accordance with yet an additional feature of the invention, there is provided a front blade edge coated with the adhesive layer and having a plurality of the bores open to the outside.

In accordance with a concomitant feature of the invention, the turbine blade is constructed as a gas-turbine guide blade or moving blade. It is additionally feasible to construct the turbine blade as a heat shield or heat-shield element for use in a gas turbine. In this case, the turbine blade may be constructed in such a way that a hot-gas flow in the form of a flue gas at a temperature above 1000° C., in particular between 1200° C. and 1400° C., flows around it during normal operation.

Other features which are considered as characteristic for the invention are set forth in the appended claims.

Although the invention is illustrated and described herein as embodied in a turbine blade which can be subjected to a hot gas flow, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
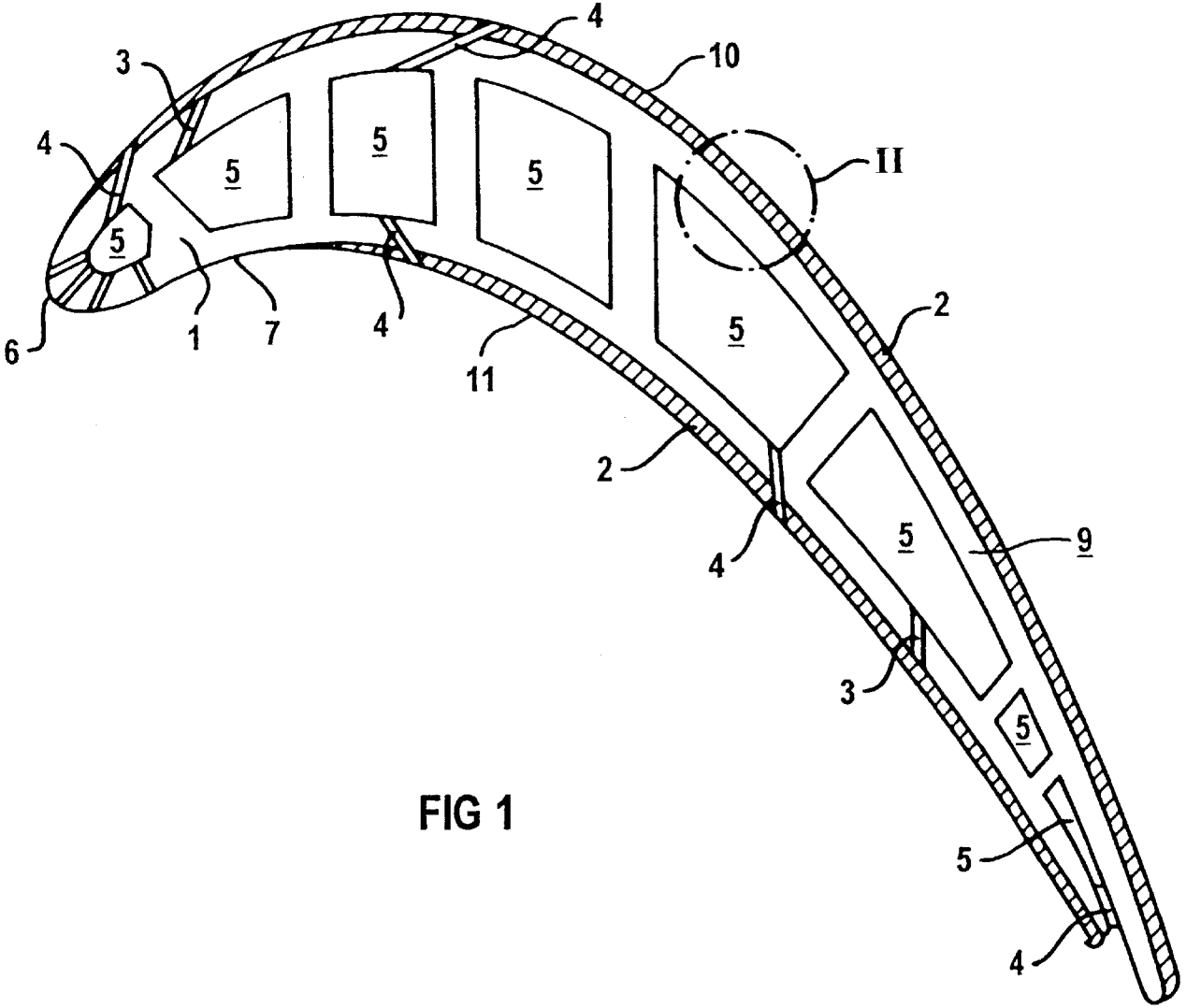
FIG. 1 is a diagrammatic, cross-section view of a profiled gas turbine blade, in particular a moving blade.

Referring now to the figures of the drawings in detail and first, particularly, to FIG. 1 thereof, there is seen a cross-section through a turbine blade constructed as a profiled gas-turbine blade, in particular a moving blade or guide blade. The turbine blade is formed of a substrate 1, which is made of a superalloy, in particular a nickel-based or cobalt-based superalloy. Such a superalloy is distinguished by high strength and low fatigue tendency under high mechanical loading at high temperatures, in particular at temperatures between 800° C. and 1200° C. In this case, the structure of the superalloy may be microcrystalline, columnar-crystalline in the form of a cluster of crystallites directed parallel (directionally solidified) to one another, or monocrystalline (single crystal).

A superalloy is selected within the limits of conventional practice with regard to its relevant mechanical properties but not with regard to its behavior under load with flue gas, which is to be directed past the turbine blade. Therefore, within the scope of conventional practice, the substrate 1 is provided with a protective coating. However, the protective coating cannot be fully seen from FIG. 1 for the sake of clarity. FIG. 1 shows a heat-insulating-layer system 2, which partly covers the substrate 1 at a suction side 10 and a pressure side 11 and which is intended to protect the substrate 1 from excessive thermal loading as well as from corrosion and oxidation caused by constituents of the gas flow flowing around it.

In addition, in order to intensify the protection from thermal loading, bores 3 and 4 are provided in the substrate 1. A coolant fed to an interior space 5 of the substrate 1 can flow through the bores 3 and 4, through the substrate 1 and form a cooling film on the turbine blade. Air, in particular, is used as the coolant, although water vapor is also suitable. The interior space 5 of the substrate 1 is shown in FIG. 1 as a multiplicity of separate chambers. These chambers normally communicate with one another, which is not shown in FIG. 1 for the sake of clarity, and may therefore be correctly indicated as a single interior space 5. However, there are no basic reservations about the provision of a plurality of interior spaces 5. The bores 3 in the substrate 1 are closed by the heat-insulating-layer system 2, since the heat-insulating-layer system 2 is constructed in such a way that a flow of coolant through these bores 3 is not necessary when the heat-insulating-layer system 2 is intact. The bores 4 are not closed and the coolant flows through them from the interior space 5 even when the heat-insulating-layer system 2 is intact. Such bores 4 are present, in particular, in the vicinity of a front edge 6 of the blade, which is subjected to the gas flow. Since this front edge 6 of the blade is reached first by the gas flow flowing around it and is preferably struck by particles possibly entrained in the gas flow, no heat-insulating-layer system 2 is attached to the front edge 6 of the blade. Therefore, in order to compensate for the increased thermal loading, the bores 4 which are not closed are provided there in appropriate number.

Of course, it is not out of the question to protect the substrate 1 in the region of the front edge 6 of the blade against corrosion and oxidation. Information in this regard will become apparent with reference to FIG. 2, which shows an enlarged portion designated by reference symbol II in FIG. 1 that is described below.

Figure 2:
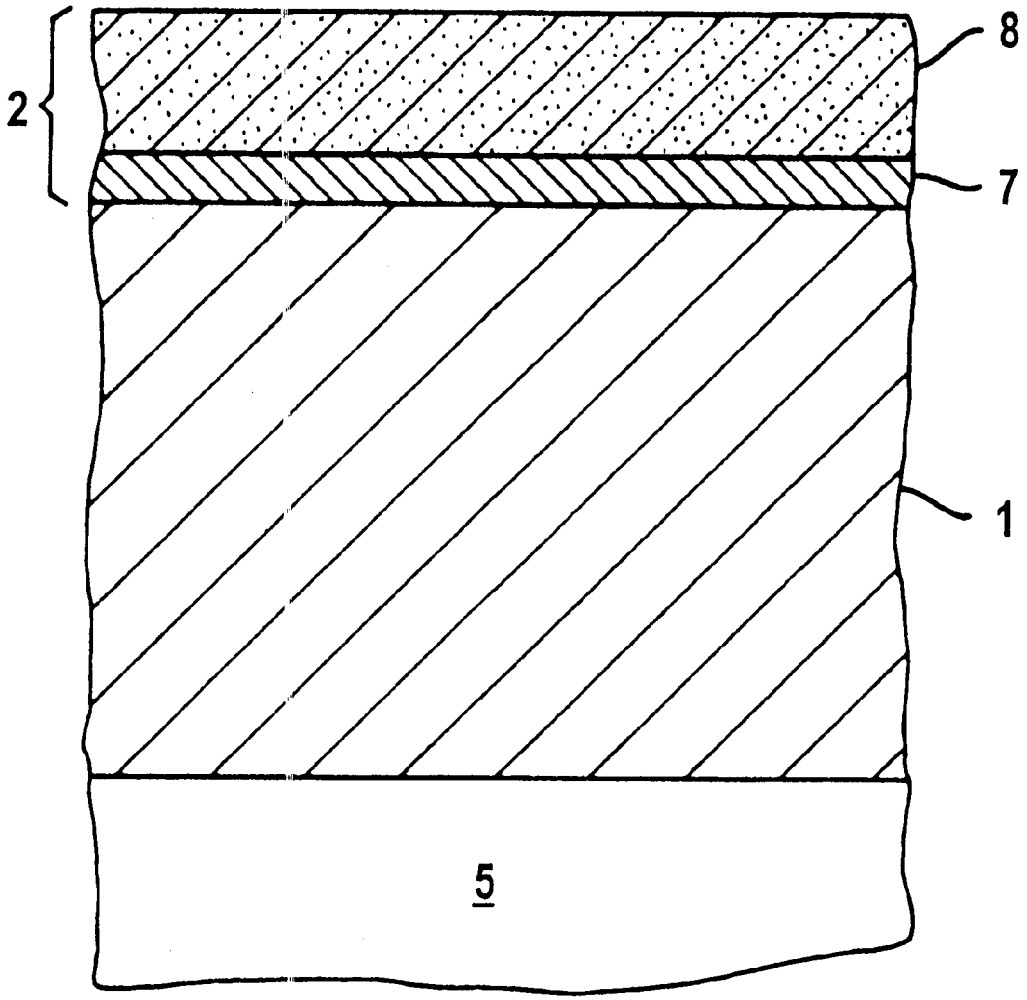
FIG. 2 is an enlarged, fragmentary, cross-section view of a portion II of FIG. 1.

FIG. 2 shows part of the substrate 1, covered by the heat-insulating-layer system 2. The heat-insulating-layer system 2 includes a metallic adhesive layer 7, which is formed of an alloy of the type MCrAlY containing a proportion by weight of the element rhenium and is distinguished by excellent resistance against corrosion and oxidation at the high temperatures being considered. This adhesive layer 7 serves to fix an actual ceramic heat-insulating layer 8, being formed of partly stabilized zirconium oxide. The adhesive layer 7 is very ductile and consequently does not involve any intrinsic risk of brittle fracture, unlike the actual ceramic heat-insulating layer 8. For this reason, the adhesive layer 7 is also eminently suitable for providing the substrate 1 with independent protection against corrosion and oxidation at the front edge 6 of the blade, seen in FIG. 1. In this case, the thermal loading of the front edge 6 of the blade is reduced by an adequate feed of coolant to such an extent that the adhesive layer 7 is not affected to an excessive degree and damaged in an undesirable manner.

I claim:

1. A turbine blade to be subjected to a hot gas flow, comprising:

a suction side;

a pressure side;

a substrate having at least one interior space and a plurality of bores leading from said interior space out of said substrate; and a heat-insulating-layer system at least partly covering at least one of said suction and pressure sides, said heat-insulating-layer system closing at least one bore and leaving at least one further bore open to emit cooling fluid for developing film cooling of said heat-insulating-layer system.

2. The turbine blade according to claim 1, wherein said at least one further bore passes through said heat-insulating-layer system.

3. The turbine blade according to claim 1, wherein said at least one further open bore is a plurality of bores disposed for uniformly cooling said substrate when a hot gas flow flows around said substrate, when the coolant is fed to said at least one interior space and when the coolant is drawn off into the gas flow through said at least one further open bore.

4. The turbine blade according to claim 1, wherein said bores are disposed for uniformly cooling said substrate when a gas flow flows around said substrate if said heat-insulting-layer system opens said at least one closed bore when the coolant is drawn off through said bores into the gas flow and fed to said at least one interior space.

5. The turbine blade according to claim 1, wherein said substrate is formed of a superalloy.

6. The turbine blade according to claim 1, wherein said heat-insulating-layer system includes a metallic adhesive layer lying on said substrate and a ceramic heat-insulating layer lying on said adhesive layer.

7. The turbine blade according to claim 6, wherein said adhesive layer is formed of an alloy resistant to corrosion and oxidation at high temperatures.

8. The turbine blade according to claim 6, wherein said adhesive layer is formed of an alloy of the MCrAlY type.

9. The turbine blade according to claim 6, wherein said heat-insulating layer is formed of an at least partly stabilized zirconium oxide.

10. The turbine blade according to claim 6, including a front blade edge coated with said adhesive layer and having a plurality of said bores open to the outside.

11. A gas-turbine guide blade to be subjected to a hot gas flow, comprising:

a suction side;

a pressure side;

a substrate having at least one interior space and a plurality of bores leading from said interior space out of said substrate; and a heat-insulating-layer system at least partly covering at least one of said suction and pressure sides, said heat-insulating-layer system closing at least one bore and leaving at least one further bore open to emit cooling fluid for developing film cooling of said heat-insulating-layer system.

12. A gas-turbine moving blade to be subjected to a hot gas flow, comprising:

a suction side;

a pressure side;

a substrate having at least one interior space and a plurality of bores leading from said interior space out of said substrate; and a heat-insulating-layer system at least partly covering at least one of said suction and pressure sides, said heat-insulating-layer system closing at least one bore and leaving at least one further bore open to emit cooling fluid for developing film cooling of said heat-insulating-layer system.

* * * * *